United States Patent [19]

Jordan

[11] Patent Number: 4,574,788

[45] Date of Patent: Mar. 11, 1986

[54] FACILE BACK SCRATCHER

[76] Inventor: Ben L. Jordan, 4327 Simsbrook, Houston, Tex. 77045

[21] Appl. No.: 660,638

[22] Filed: Oct. 15, 1984

[51] Int. Cl.[4] ..... A61H 7/00

[52] U.S. Cl. ..... 128/67; 128/62 R

[58] Field of Search ..... 128/67, 62 R; D28/99; 403/252, 378, 379; 144/353

[56] References Cited

U.S. PATENT DOCUMENTS

| | | | |
|---|---|---|---|
| 129,164 | 7/1872 | Pearce | 403/255 |
| D. 260,694 | 11/1979 | Mallett | D28/99 |
| D. 266,280 | 2/1980 | Toyama | D28/99 |
| 869,250 | 10/1907 | Martin | 128/62 R |
| 1,212,442 | 1/1917 | Blaine | 252/104 |
| 2,154,846 | 4/1939 | Heymann | 128/62 |
| 3,907,181 | 9/1975 | Thomas | 223/111 |
| 4,071,021 | 1/1978 | Gallacci | 128/52 |
| 4,091,805 | 5/1978 | Clark | 128/41 |
| 4,483,356 | 11/1984 | Kales | 128/67 |
| 4,493,315 | 1/1985 | Iwahashi | 128/67 |

*Primary Examiner*—Edgar S. Burr
*Assistant Examiner*—Tonya Eckstine
*Attorney, Agent, or Firm*—Pravel, Gambrell, Hewitt & Kimball

[57] ABSTRACT

A back scratcher which includes: (a) a rigid, elongated rod having an axial portion and a canted portion which meet at an obtuse angle; (b) a handle fixedly attached about the free end of the axial portion; (c) a scratcher head fixedly attached to the free end of the canted portion; and (d) a plurality of closely spaced tines extending from the scratcher head in a direction parallel to the plane containing the axial and canted portions. In various embodiments, the back scratcher is provided with thumb-engagable means formed on the handle for aligning the tines to engage the back, with a removable base for mounting the back scratcher in an upright disposition while being stored, with different angles and lengths of the axial portion and the canted portion for operation over or under a shirt, with a novel means of attaching the scratcher head to the rod, and with resharpenable tines.

15 Claims, 6 Drawing Figures

FACILE BACK SCRATCHER

FIELD OF THE INVENTION

This invention relates to a hand-operated back scratcher, and particularly to a back scratcher which is especially convenient in operation.

BACKGROUND OF THE INVENTION

In its simplest form, a hand operated back scratcher comprises an elongated handle or shaft which has affixed to one end means for engaging the back. In operation, the free end distal the back-engaging means is grasped in the hand and the back-engaging means is placed either over the shoulder or under the arm, pressed against the back and reciprocated. By pressing the back-engaging means against the back, typically through a moment imparted to the shaft by manipulation with the grasping hand, a massaging or scratching action results.

The simple back scratching device heretofore known has had many attendant inconveniences associated therewith. For example, the natural tendency is to grasp the back scratcher in such a manner that the back-engaging means is not in proper alignment with the back so that either the elbow and/or wrist must be in an awkward position to permit proper alignment, or the back scratcher must be regrasped. For example, in U.S. Pat. No. 4,091,805 there is illustrated an electrically vibrated back scratcher in which the handle is provided with a "bicycle grip", that is, a plurality of grooves corresponding with the four fingers of the hand with which the handle is grasped. As shown in that patent, when the device is operated over the shoulder, proper engagement of the back by the back-engaging means when the handle is grasped as intended is only effected with a positioning of the elbow and arm to the side of the user substantially in the plane of the torso.

Another inconvenience with back scratchers heretofore known is that the handle and the back-engaging means are connected by a long, straight shaft. When such a back scratcher is operated over the shoulder, extension of the arm is required so that the shaft will clear the shoulder. Similarly, when prior art back scratchers are operated under the arm, the elbow and arm must be positioned inconveniently behind the plane of the torso to permit clearance of the shift across the side of the torso. In either mode of operation, the extension of the arm required to reach the nearer portion of the back is made more extreme by the length of the shaft. Often, this extreme reaching with known back scratchers is nearly as difficult as scratching the back without the use of such a device.

It is also desirable to be able to store a back scratcher conveniently, safely and attractively when the device is not in use. One manner of storage has been to hang the device on a projection extending from a wall, such as a nail, for example, through a loop or eye formed in the handle of the device such as is shown, for example, in U.S. Pat. No. 869,250 and in U.S. Pat. No. Des. 266,280. Another method has been to form a base on the handle on which the device may be rested upright while not in use as illustrated in U.S. Pat. No. Des. 260,694. However, such a base must have a substantial surface area and/or be weighted if the back scratcher is not to be too easily tipped over when stored in the upright position. Such a base inconveniences the operation of the back scratcher because of the extra weight which must be lifted and/or because of the tendency of the base to interfere with the movement of the hand during manipulation of the device.

Still another inconvenience associated with back scratchers is that the back-engaging means tends to become worn with use such that the massaging of the back becomes more difficult, because of the increased pressure which must be applied to obtain satisfaction, eventually necessitating replacement of the back-engaging means or the entire back scratcher. One attempt at solving this problem is described in U.S. Pat. No. 1,212,443 in which the head of the back scratcher is provided with a plurality of rounded projections formed on opposite edges of a channel. With this device, when the rounded projections become worn from use, the head may be reconditioned by running a file through the channel and between the rounded projections. However, it is believed that such rounded projections when moved across the back are not as satisfying when a shirt is worn. Moreover, the rounded projections on the device described in U.S. Pat. No. 1,212,443 present a flat surface to the back and it is difficult to engage the concave surfaces of the back therewith, such as the small of the back, without twisting the device with the hand in an awkward position. In addition, the head and the handle are connected by screw threads which have a tendency to unscrew when the head is rotated against the handle in a counter-clockwise direction as might occur when it is twisted to engage the concave portions of the back.

SUMMARY OF THE INVENTION

The present invention is a back scratcher which may be used with great facility and which may be conveniently, safely and attractively mounted in an upright position on a removable base which does not interfere with or inconvenience the operation of the back scratcher. In addition, the back scratcher may be used either under or over a shirt worn on the back, may be readily grasped for proper engagement of the back with the back-engaging means without regrasping of the handle or awkward positioning of the hand or arm, and which is lightweight for added convenience.

Briefly, the invention is a back scratcher which includes (a) a rigid, elongated rod having an axial portion with a first free end and a canted portion with a second free end, said portions meeting at an obtuse angle, (b) a handle attached about the first end and positionally fixed in relation thereto, the handle being graspable by the hand, (c) a scratcher head attached to the second end and positionally fixed in relation thereto, (d) a plurality of tines extending from the scratcher head in a direction parallel to the plane defined by the axial and canted portions, the tines presenting an arcuate ridge for engaging a concave portion of the back, and (e) depression means formed on the handle for receiving the thumb when the handle is grasped by the hand, whereby the tines are aligned to engage the back when the back scratcher is placed over the shoulder. Preferably, the axial portion is provided with a coaxial bore formed therein, and the back scratcher is in combination with a stand including a base portion and a cylindrical portion, the cylindrical portion extending vertically from the base portion and being removably engageable by the bore to maintain the axial portion in an upright disposition. The invention is described in more detail in the accompanying drawings and detailed description of the preferred embodiments which follow.

DETAILED DESCRIPTION OF THE PREFERRED EMBODIMENTS

Figure 1:
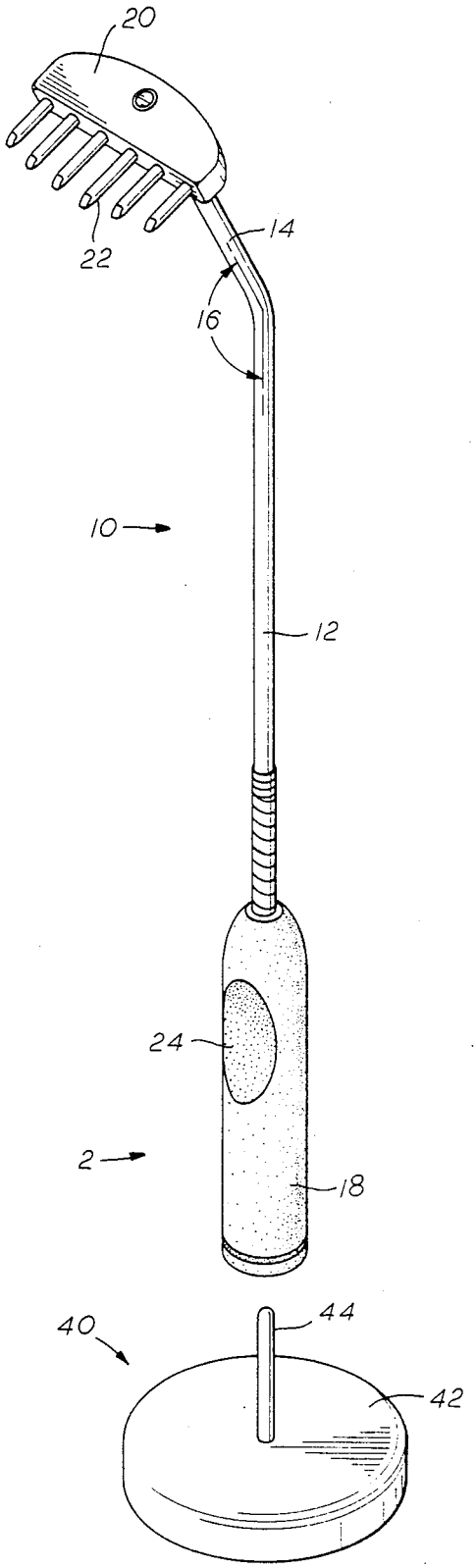
FIG. 1 is a perspective, exploded view of the back scratcher of the invention.
Figure 2:
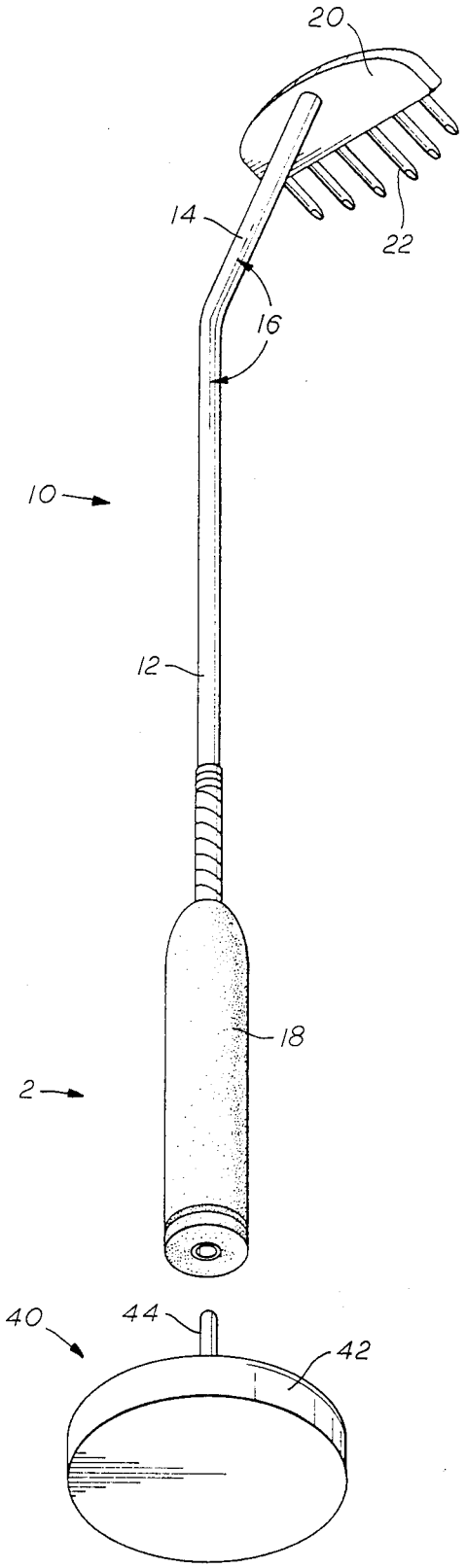
FIG. 2 is a perspective, exploded view from a different angle of the back-scratcher seen in FIG. 1.

Referring to FIGS. 1 and 2, back scratcher 2 is provided with rigid, elongated rod 10 which includes axial portion 12 and canted portion 14 which meet at obtuse angle 16. Handle 18 is fixedly attached about the free end of axial portion 12. Scratcher head 20 is fixedly attached to the free end of canted portion 14. Closely spaced tines 22 extend from scratcher head 20 in a direction parallel to the plane containing axial portion 12 and canted portion 14. Depression 24 is formed on handle 18 and is adapted to accommodate the thumb when handle 18 is grasped by the hand.

In operation over the shoulder, handle 18 is grasped by either the right or left hand with the thumb placed on depression 24. The back scratcher 2 is then positioned over the shoulder so that the ridge formed by tines 22 engages the back. With the illustrated device, this is accomplished by reaching over the shoulder toward the back with the arm bent at the elbow. In such a position, the arm is in a convenient and natural position of about 45° to the plane of the torso. With the hand held in a natural position, tines 22 extending from scratcher head 20 are in proper alignment for engagement of the back. A massaging or scratching action is achieved by reciprocating the scratcher up and down the back while pressing gently with a moment applied to rod 10 from the wrist.

In operation under the arm, handle 18 is grasped by either the right or the left hand with the first phalanx of the index finger or the side of the thumb placed on depression 24. The back scratcher 2 is then positioned under the arm so that the ridge formed by tines 22 engages the back. This is accomplished by reaching under the arm toward the back with the arm bent at the elbow. In such a position, the arm is conveniently and comfortably in or just behind the plane of the torso. With the hand held in a natural position, tines 22 extending from scratcher head 20 are easily aligned for engagement of the back by means of depression 24.

In a preferred embodiment, the use of the device is facilitated by constructing back scratcher 2 with durable, lightweight materials. Rod 10 is preferably of thin-walled, tubular construction of a material such as steel or aluminum, for example, 5/16-inch 0.D. by 0.028-inch wall T-6061 aluminum alloy.

When the back scratcher is to be utilized primarily over a shirt or on a bare back, it is preferred that the length of canted portion 14 is from about 2 to about 4 inches, most preferably about 3 inches. For such an application it is also preferred that axial portion 12 and canted portion 14 meet at obtuse angle 16 of from about 147° to about 167°, most preferably about 157°.

Figure 3:
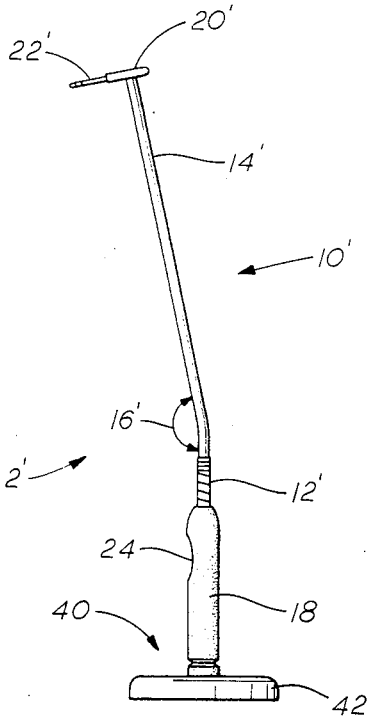
FIG. 3 is a perspective view of an alternate embodiment of the back-scratcher of the invention.

In FIG. 3 is shown an alternate embodiment of the back scratcher which is particularly useful when the scratcher head is placed under the collar of a shirt. In this embodiment, the length of axial portion 12' is from about 7 to about 8 inches, most preferably about 7.5 inches. It has been found that when using the back scratcher under the collar of a shirt, angle 16' at which the axial portion and the canted portion meet should be slightly more than the embodiment of the device preferred for use over a shirt, preferably from about 165° to about 175°, most preferably about 170°.

In either embodiment, the angle at which axial portion 12 and canted portion 14 meet permits engagement of the tines of the scratcher head with the back with minimal extension of the arm. In contrast to the prior art back scratchers, only a minimal extension of the arm is required to permit sufficient clearance of rod 10 over the shoulder or across the side of the torso. To further facilitate operation of the back scratcher, the overall length of rod 10, that is, the sum of the lengths of axial portion 12 and canted portion 14, is preferably from about 16 inches to about 20 inches, most preferably about 18 inches. If the back scratcher is longer than about 20 inches, it is difficult for most persons to reach the nearer portions of the back because of the required extension of the arm. On the other hand, if the back scratcher is shorter than about 16 inches, it is difficult for most persons to reach the more distant portions of the back. It is also preferred that tines extend from about 0.75 in. to about 1.25 in., preferably about 0.875–1.0 in., from a line which is transverse to tines 22 and perpendicularly intersects canted portion 14.

In another preferred embodiment, handle 18 is substantially in the shape of a right circular cylinder coaxial with axial portion 12 of rod 10. Such a shape is readily adapted to be gripped between the thumb and fingers of the hand. While any suitable material may be used to manufacture the handle, it is preferred to use a durable, lightweight elastomeric material, such as, for example, chlorosulfonated polyethylene available from E. I. DuPont de Nemours under the trade name Hypalon blended with a filler material such as spherulitic volcanic glass such as perlite available from Grefco, Inc. under the trade name Permalite. Preferably, by providing the handle with an axial bore formed through the longitudinal length thereof which has an inside dimension slightly less than the outside dimension of rod 10, the handle is conveniently attached securely about the free end of axial portion 12. Alternatively, adhesives may be employed, or handle 18 and axial portion 12 may be of unitary construction.

It is most preferable that depression 24, or other thumb-engagable means, is formed on handle 18 for aligning the tines to properly engage the back. While a thumb-accommodating depression is illustrated and is preferred, it is readily appreciated that other tactile indicia may be substituted therefor.

Figure 4:
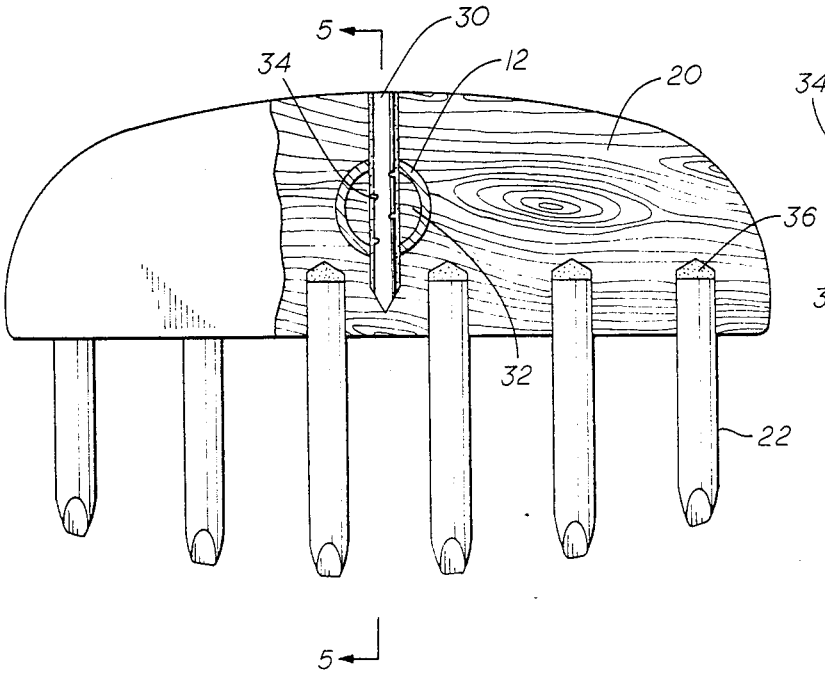
FIG. 4 is a perspective end view, partly in section, of the scratcher head attached to the back scratcher.
Figure 5:
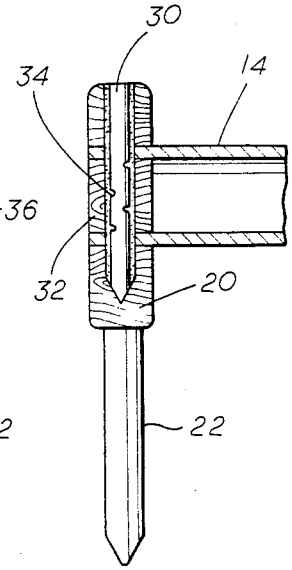
FIG. 5 is a sectional view of the scratcher head of the back scratcher as seen along the lines 5—5 in FIG. 4.

As seen in FIGS. 4 and 5, scratcher head 20 is fixedly attached to the free end of canted portion 14 of rod 10. This is accomplished by providing scratcher head 20 with the shape of a bar, that is, with length and width dimensions much greater than the thickness dimension, for example, 2.5 in.×0.75 in.×0.25 in. Such a shape permits adequate attachment of the scratcher head to the rod and anchoring of the tines, while permitting a lightweight construction. Preferably, scratcher head 20 is provided with a bore formed through the thickness thereof at about the median length thereof. As seen in FIG. 4, the bore engages the free end of canted portion 14 of rod 10. Preferably, scratcher head 20 is fixedly attached to the rod by means of pin 30 securely positioned transversely through rod 10 and extending abaxially from both sides thereof into scratcher head 20. In an especially preferred embodiment, the end of canted portion 14 is provided with a coaxial bore formed therein which accommodates disc-shaped plug 32 placed flush with the end of canted portion 14. By providing a bore formed in plug 32 and scratcher head 20 extending in a direction transverse to canted portion 14, pin 30 may be easily inserted. It is also preferred that pin 30 is provided with serrations 34 corresponding to the extension of pin 30 through the bore in plug 32. By filling the serrations with a hard solid material, such as a glue or adhesive, which is strongly bonded to the material of the plug, scratcher head 20 is securely attached to rod 10. Preferably, scratcher head 20 is made from a durable, lightweight material, such as, for example, a hardwood, preferably Kingwood.

In another preferred embodiment, tines 22 extend from scratcher head 20 and terminate such that tines 22 present an arcuate ridge for engaging the concave portions of the back. Preferably, the tines terminate in dihedrally shaped edges. It is also preferred that the tines are made from a material which facilitates sharpening of the edges with an abrasive tool such as sandpaper. The preferred material is a hardwood, such as, for example, birch. Preferably, the tines are anchored in scratcher head 20 by gluing them in recesses 36. Alternatively, tines 22 and scratcher head 20 may be of unitary construction.

Figure 6:
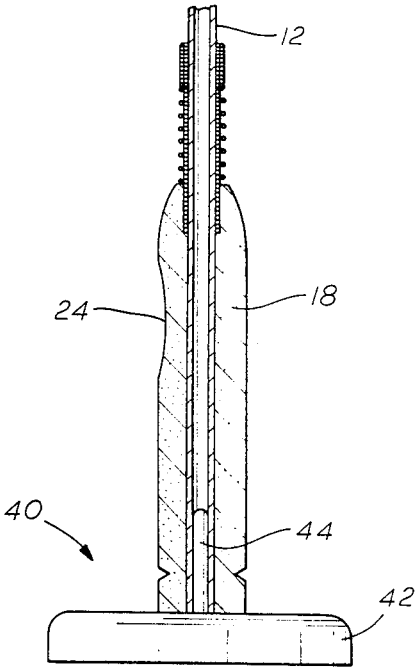
FIG. 6 is a side sectional view of the axial portion of the back scratcher shown at rest on a removable base.

In another preferred embodiment, the back scratcher of the invention is provided with a removable base which permits storage of the back scratcher in an upright, vertical disposition. As seen in FIG. 6, this is accomplished by providing axial portion 12 with a coaxial bore formed therein, facilitating storage on stand 40 which includes weighted base portion 42 and cylindrically shaped portion 44 extending substantially vertically from base portion 42 and adapted to be removably engaged by the bore formed in axial portion 12 to maintain the axial portion in an upright disposition. Preferably, stand 40 is heavier than the combined weight of rod 10, handle 18, scratcher head 20 and tines 22 for stability to prevent the back scratcher from tipping over when inadvertently bumped. The stability is also enhanced when handle 18 is heavier than the combined weight of scratcher head 20 and tines 22.

While I have described my back scratcher above, many other variations will occur to those skilled in the art. It is intended that all such variations which fall within the scope and spirit of the appended claims be embraced thereby.

I claim:

1. A back scratcher comprising:

an elongated rod having an axial portion with a first free end and a canted portion with a second free end, said portions meeting at an obtuse angle;

a handle attached about said first end and positionally fixed in relation thereto, said handle being graspable by the hand;

a scratcher head attached to said second end and positionally fixed in relation thereto;

a plurality of tines extending from said scratcher head in a direction parallel to the plane defined by said axial and canted portions, said tines presenting an arcuate ridge for engaging a concave portion of the back; and depression means formed on said handle for receiving the thumb when said handle is grasped by the hand, whereby said tines are aligned to engage the back when the back scratcher is placed over the shoulder.

2. The back scratcher of claim 1, wherein said rod is tubing.

3. The back scratcher of claim 1, wherein the length of said canted portion is from about 2 inches to about 4 inches.

4. The back scratcher of claim 3, wherein said axial portion and said canted portion meet at an obtuse angle of from about 147° to about 167°.

5. The back scratcher of claim 4, wherein said angle is about 157° and said canted portion length is about 3 inches.

6. The back scratcher of claim 1, wherein the length of said axial portion is from about 7 inches to about 8 inches.

7. The back scratcher of claim 6, wherein said axial portion and said canted portion meet at an obtuse angle of from about 165° to about 175°.

8. The back scratcher of claim 7, wherein said angle is about 170° and said axial portion length is about 7.5 inches.

9. The back scratcher of claim 1, wherein the overall length of said rod is from about 16 inches to about 20 inches.

10. The back scratcher of claim 1, wherein said scratcher head is provided with a bore formed through the thickness thereof at about the median length thereof, said bore engaging said second end of said rod, said scratcher head attached to said rod by means of a pin securely positioned through said rod and extending abaxially from both sides thereof into said scratcher head.

11. The back scratcher of claim 10, wherein said second end is provided with a coaxial bore formed therein which accommodates a disc-shaped plug placed flush with said second end, said pin extending through a bore formed in said plug, said pin being provided with serrations corresponding to said extension of said pin through said bore formed in said plug, said serrations being filled with a solid material bonded to said plug.

12. The back scratcher of claim 1, wherein said tines terminate in dihedrally shaped edges.

13. A back scratcher and stand in combination, comprising:

an elongated rod having an axial portion with a first free end and a canted portion with a second free end, said axial portion being provided with a co-axial bore formed therein, said portions meeting at an obtuse angle;

a handle attached about said first end and positionally fixed in relation thereto, said handle being graspable by the hand;

a scratcher head attached to said second end and positionally fixed in relation thereto;

a plurality of tines extending from said scratcher head in a direction parallel to the plane defined by said axial and canted portions, said tines presenting an arcuate ridge for engaging a concave portion of the back;

depression means formed on said handle for receiving the thumb when said handle is grasped by the hand, whereby said tines are aligned to engage the back when the back scratcher is placed over the shoulder; and a stand comprising a base portion and a cylindrical portion, said cylindrical portion extending vertically from said base portion and being removably engageable by said bore to maintain said axial portion in an upright disposition.

14. The back scratcher of claim 13, wherein said stand is heavier than said rod, said handle, said scratcher head and said tines in combination.

15. The back scratcher of claim 14, wherein said handle is heavier than said scratcher head and said tines in combination.

* * * * *